United States Patent [19]

Sero et al.

[11] Patent Number: 4,843,785

[45] Date of Patent: Jul. 4, 1989

[54] ANCHORING AND FOUNDATION SUPPORT APPARATUS AND METHOD

[75] Inventors: Samuel J. Sero, Pittsburgh; James S. Collins, Monaca; Victor Yates, Sewickley, all of Pa.

[73] Assignee: Secure Anchoring & Foundation Equipment, Inc., Aliquippa, Pa.

[21] Appl. No.: 168,268

[22] Filed: Mar. 15, 1988

Related U.S. Application Data

[63] Continuation-in-part of Ser. No. 878,859, Jun. 26, 1986, abandoned, which is a continuation-in-part of Ser. No. 647,172, Sep. 4, 1984, abandoned.

[51] Int. Cl.[4] ..... E02D 5/74

[52] U.S. Cl. ..... 52/160; 52/742

[58] Field of Search ..... 52/160, 155, 170

[56] References Cited

U.S. PATENT DOCUMENTS

| | | | |
|---|---|---|---|
| 756,374 | 4/1904 | Justus | 52/160 |
| 787,017 | 4/1905 | Witmer | 52/160 |
| 817,044 | 4/1906 | Cissna | 52/160 |
| 948,532 | 2/1910 | Stocking | 52/161 |
| 978,505 | 12/1910 | Stewart | 52/155 |
| 1,173,806 | 2/1916 | Johnson . | |
| 2,955,430 | 10/1960 | Alston | 52/160 X |
| 3,056,477 | 10/1962 | Wooley . | |
| 3,118,284 | 1/1964 | Cobi . | |
| 3,131,544 | 5/1964 | Thornley . | |
| 3,187,858 | 6/1965 | Des Champs . | |
| 3,214,918 | 11/1965 | Binnings . | |
| 3,222,842 | 12/1965 | Luedluff et al. | 52/742 |
| 3,432,977 | 3/1969 | Scholl | 52/98 |
| 3,512,319 | 5/1970 | Piacentino | 52/160 |
| 3,525,187 | 8/1970 | Vincent | 52/155 |
| 4,015,433 | 4/1977 | Shibata | 52/160 X |

*Primary Examiner*—Carl D. Friedman

*Attorney, Agent, or Firm*—Webb, Burden, Ziesenheim & Webb

[57] ABSTRACT

An anchor or foundation apparatus and a method for installing said apparatus in an earthen hole. The apparatus employs pivotally swingable plates which swing in an arc upwardly or downwardly into the surrounding media to fix the device therein. The surface of the plates forced into the surrounding media is provided with oppositely disposed rib means extending along the upper and lower edges of the plates and said rib means serve as media containment means. The media containment means extends the zone of media consolidation and the plane for dislodgement of the device a considerable distance outwardly into the surrounding media. The hydraulic force exerted to swing the plates into the surrounding media is measured, from which the strength of the installation is known.

65 Claims, 9 Drawing Sheets

Fig. 8.
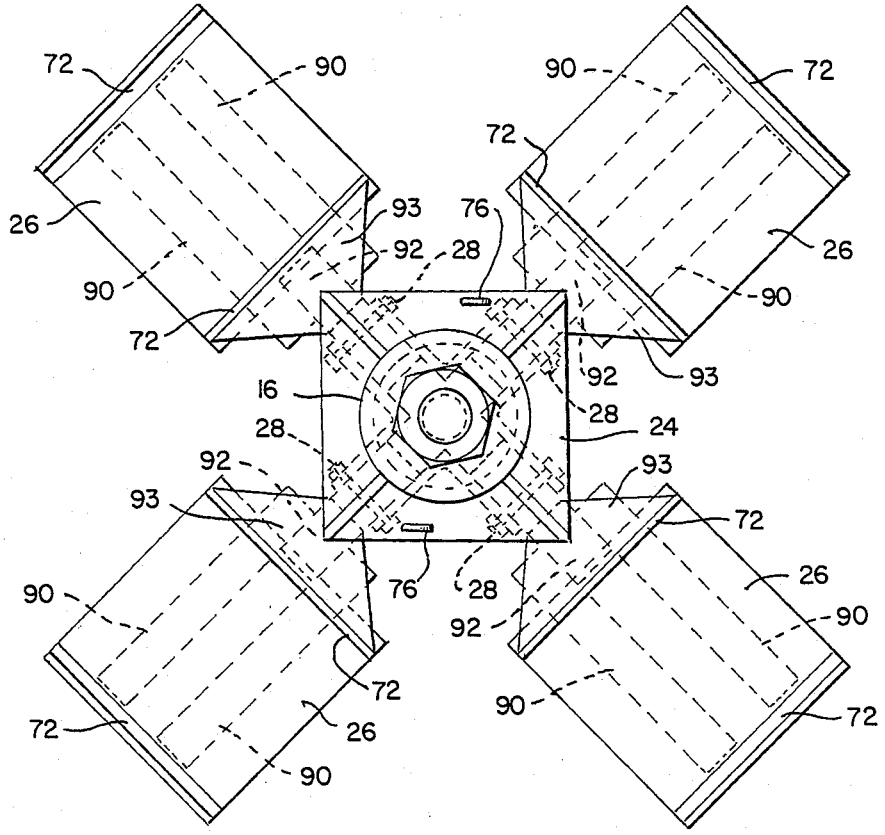
Fig. 6.
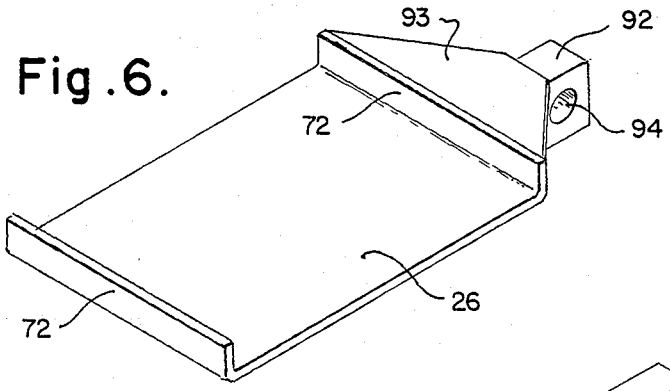
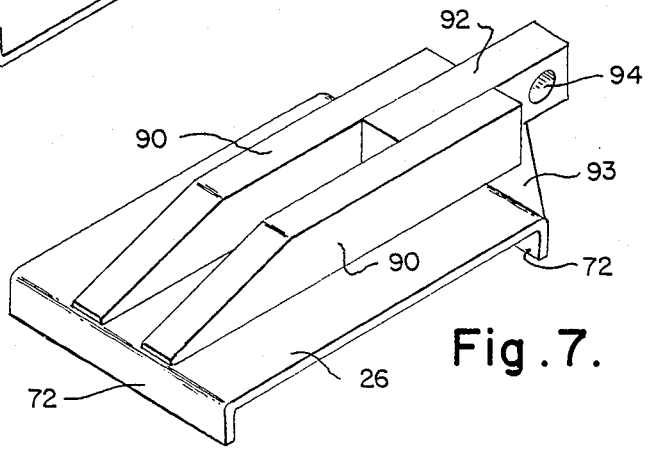
Fig. 7.

ANCHORING AND FOUNDATION SUPPORT APPARATUS AND METHOD

This application is a continuation-in-part of Ser. No. 878,859, filed June 26, 1986, now abandoned, which was a continuation-in-part of Ser. No. 647,172, filed Sept. 4, 1984, now abandoned.

This invention relates to an apparatus and method for installing a structural anchor or foundation in an earthen hole.

The apparatus and method of this invention strengthens media by utilizing shear strength, which is the strongest component of media strength. In operation, the apparatus acts to prestress a portion of the surrounding media, expand the load bearing zone of influence and develop a controlled and measurable shear plane out in the surrounding media.

The mechanisms of compaction and consolidation of any media to achieve greater strengths have been known but are more significantly utilized by this device. Likewise it has been recognized that the shear strength of a media is its strongest and most measurable component but, until this device, the shear value of a media has been solely a topic of laboratory analysis.

In operation, the device uses an external hydraulic setting tool to apply extreme forces to the surrounding media. Upon application of these forces the first mechanism of operation to occur is the compaction of the media to displace any moisture or air pockets. This has the effect of forcing the particles of the media into a direct and cohesive contact. Upon continued application of external force the particles are interlocked or consolidated into a denser media, synonymous with the formation of a sandstone from sand particles. Throughout the compaction and consolidation phases the device is developing a controlled shear plane out in the media away from the device. The mechanism of measuring the shear value, as employed in the laboratory, is duplicated in this field installation. It is therefore possible to make a direct gauge reading of a known quantity that is the actual developed strength of the media to resist anchor or foundation loading.

All of the presently used or known anchoring and foundation methods utilize only a frictional developed zone of influence, which is the lesser component of a media's strength, to resist loading. Because it is not only the lesser component but also the least capable of being measured with any degree of accuracy or reliability, present systems are conservatively overdesigned, labor and material intensive and/or economically unfeasible to manufacture and utilize in the sizes required to achieve any usable degree of strength.

Present anchor technology and use is predicated on the most economical way of placing a frictional anchor, dead man anchor, or object of equivalent load weight into the earth. Foundation design is based on placing a concrete mat below frost level with a surface area large enough to distribute the load into the earth below, or a frictional device such as a pile. None of these devices have a direct method of exactly determining its load resisting or bearing capacity. Without prior preparation of the media, they do not upon installation increase the media's load bearing capacity or consolidate the soil to eliminate settlement or creep, or prestress the installation above loading requirement, to assure the structure's capability of carrying required loading. All require random soil borings and laboratory testing to estimate the media's strength in its natural state. These data are then averaged to estimate overall site conditions. Structure design is then accomplished with safety factors attempting to compensate for the inconsistencies in the testing process and site conditions. Testing of a structure's strength cannot be accomplished without destroying its integrity. Due to economic pressure, site pre-investigation and media testing is reduced or eliminated and the structure's reliability becomes questionable. This creates unpredictable future costs in correcting structural damage due to failure, whether partial or full, and other created liabilities.

The device of this invention minimizes costs, eliminates the need of in-ground concrete, eliminates the need for costly deep drilling and media analysis, and estimates approximating the holding strength by providing an actual measurement of the structure's strength.

The apparatus of the present invention is a structure securing or bearing device in which a smooth and continuous hydraulic force is applied to outwardly swing pivoted consolidating and shear control plates in a compacting and consolidating motion into the walls of a hole in any media. The hydraulic force that is required by the consolidating and shear plates to compact and consolidate the surrounding media provides a controlled shear plane in the media.

The device requires preparation as by augering a hole in the media followed by lowering of the device into the hole so that the device rests at the bottom of the hole. Once the device is installed, hydraulically actuated motive means forces the plates to swing outwardly in an arc to compact and consolidate the surrounding media. If a solid mass such as rock resists compacting and consolidation when employing large plates, the plates can be removed and smaller plates used, or plates with cutting edges may be used. With looser media, such as sand, large plates may be substituted. It should be understood that the term media as used herein includes all types of land composition, be it rock, clay, sand, soil or other and mixtures thereof. The device utilizes the compaction, consolidation and positioning of the shear plane to maximize the load bearing strength of the media at any given setting force.

The device of this invention avoids the use of in ground concrete. It secures anchors and foundations and gives an actual reading of the set structures strength in restraint or bearing through direct gauge readings of the force applied to actuate the motive means.

The apparatus of this invention comprises central rod means, compaction and consolidation plate assembly means with a central opening for concentrically mounting said plate assembly means about said central rod means, said compaction and consolidation plate assembly means having a plurality of circumferentially spaced outwardly swingable compaction and consolidation plates mounted thereon, spreader means adapted to swing said compression and consolidation plates outwardly into the surrounding media for an arc up to 45 or 55 degrees, limiting means adapted to limit said swing to an arc of 45 or 55 degrees, force applying means adapted to force said spreader means into swinging said plates into said surrounding media and compacting and consolidating and positioning the shear plane for any applied force in said media, restraining means for restraining said plate assembly means from vertical movement during said swing, and media containment means on said plates to cooperatively function with the surfaces of said plates facing the media to contain respective portions of said media.

It is a critical feature of this invention that the swingable plates are provided with media containment means. The media containment means can comprise peripheral rib-like members along the upper and lower edges of the plates. As the plates swing outwardly into the surrounding media, the media containment means cooperate with the plate surfaces facing the media to entrap or contain respective plug-like portions of the media on the plate surfaces which are urged into the media. When the surrounding media is earth and the plates swing outwardly over even a small arc, the compacted earth in the vicinity of the plates tends to consolidate and become rock-like. Increases in hydraulic force to increase the arc from above 0 up to 45 or 55 degrees enlarges the mass of earth which is consolidated into a rock-like material. The greater the mass of consolidated material which is formed, the greater the area of earth that must be sheared to dislodge the device. In addition, a rock-like plug or portion of consolidated earth is wedged onto the plate surface by the containment means and this plug eliminates frictional failure at the plate and resists shearing of the consolidated earth near the plate. Both of these shearing features require a greatly increased force to dislodge an apparatus of this invention having media containment means, as compared to a similar device without media containment means.

An unusual feature of an apparatus of this invention having media containment means on the compaction and consolidation plates is that when it is used to consolidate soil it provides a maximum shearing area, and therefore a maximum securing strength, when the plates are swung outwardly to an arc of no more than about 45 or 55 degrees. When the arc increases above 45 or 55 degrees, there is a reduction in the shearing area and therefore also a reduction in the securing strength. Therefore, the apparatus is provided with limiting means to limit the swing to 45 or 55 degrees. By way of contrast, a similar apparatus without media containment means in the same soil media reaches a maximum shearing area when the plates are swung outwardly over an arc of 90 degrees, but that shearing area is considerably less than the shearing area achieved at a 45 degree arc with the apparatus of this invention.

It is noted that when the apparatus of this invention is employed in a rock media, it will generally not be possible to swing the plates over as great an arc as when the surrounding media is soil. In general, a useful arc setting range in a rock media is about 5 to 15 degrees. In either case, an indirect indication of the arc through which the plates are swung in a subterranean location can be provided at the surface by measuring the vertical distance of movement of the rod carrying the spreader means used to swing the plates outwardly.

The use of gauge means to measure the hydraulic force used to swing the plates into the surrounding media is an important feature of the invention. Such pressure gauge means will provide indications of any significant incremental increases in force requirements to swing the plates outwardly over progressive arc increments. Such increases in force will be indicative of enhanced consolidation of the soil media. Since the consolidation of earth is enhanced by the use of the media containment means, full advantage of the media containment means is indicated by gauge means.

The use of pressure gauge means will be required when the device is used to test the nature of the surrounding media at various depths in a particular hole. In such case, the device is expanded at various depths of the hole and the reading on the pressure gauge required to swing the plates over a given arc and into the surrounding media will be indicative of the nature of the media at the depth being tested. The device is provided with hook receiving means for collapsing the device after each test and moving it to a different location or out of the earthen hole. By this method, a proper media strata can be selected for good support.

The media containment means can be defined by one or more ribs on the periphery of the surface of the swinging plates. These ribs can be of any useful configuration. For example, when the surrounding media is earth the leading surface of the ribs can be blunt. When the surrounding media is rock, a leading edge can be employed. Because the ribs function cooperatively with the surface of the plates facing the media to contain the media upon spreading and continue to do so upon a force for dislodgement, said plate should not have a surface which tends to shed the media upon spreading.

The invention will be more fully understood by reference to the attached drawings in which.

Figure 2:
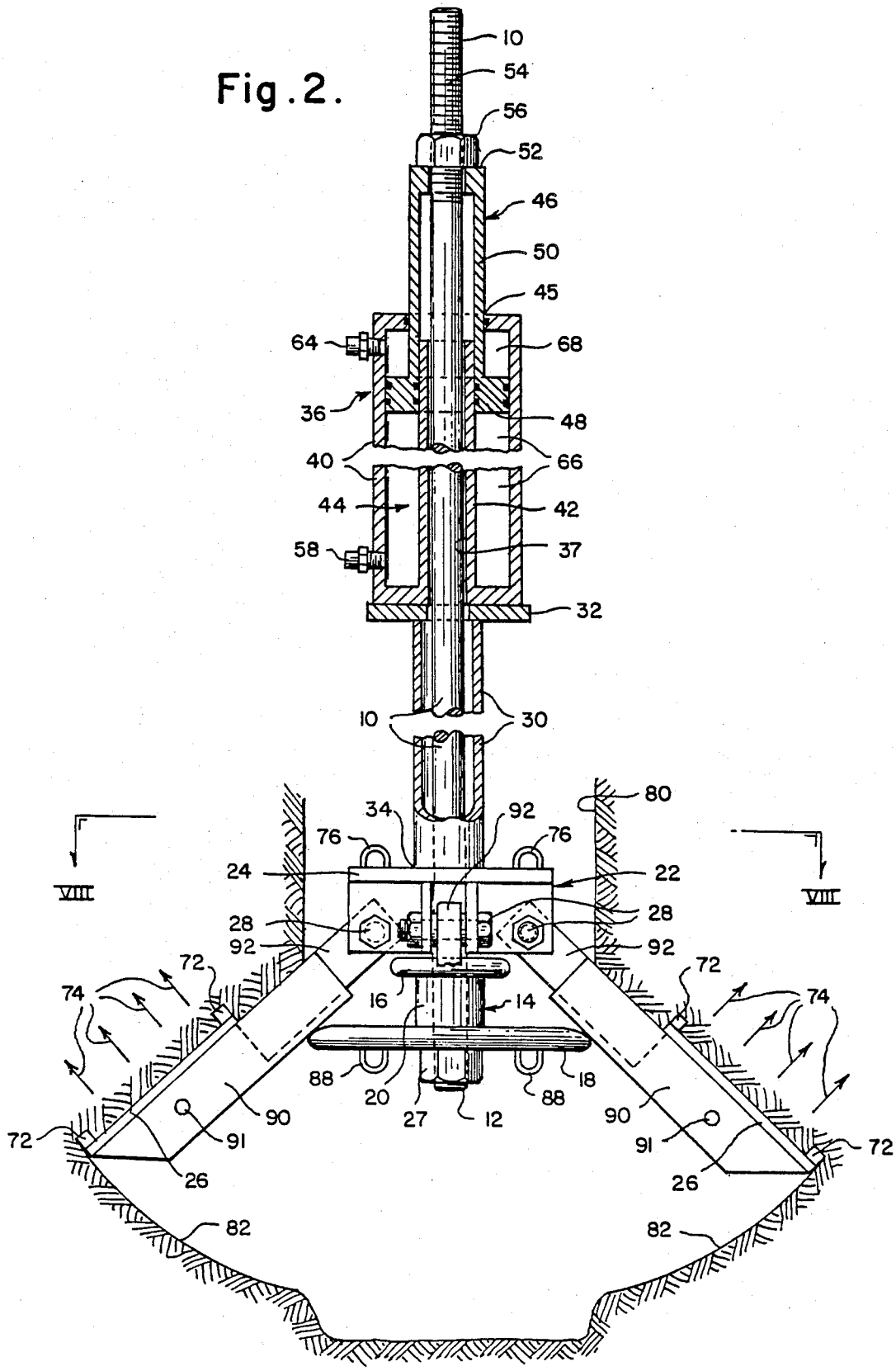
FIG. 2 illustrates our device extended for operation in the anchor mode.
Figure 9:
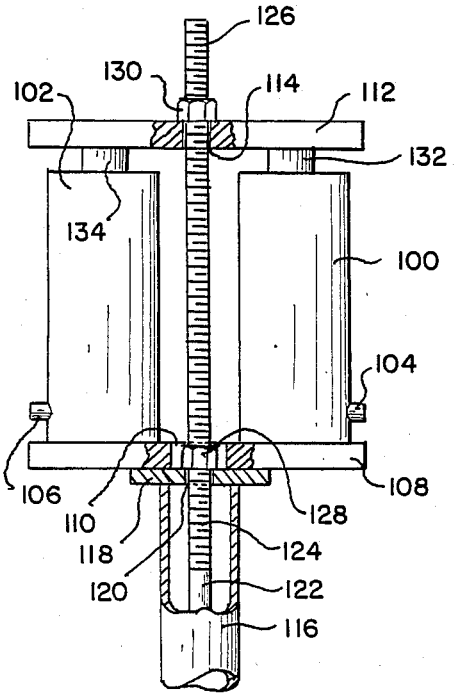
Figure 10:
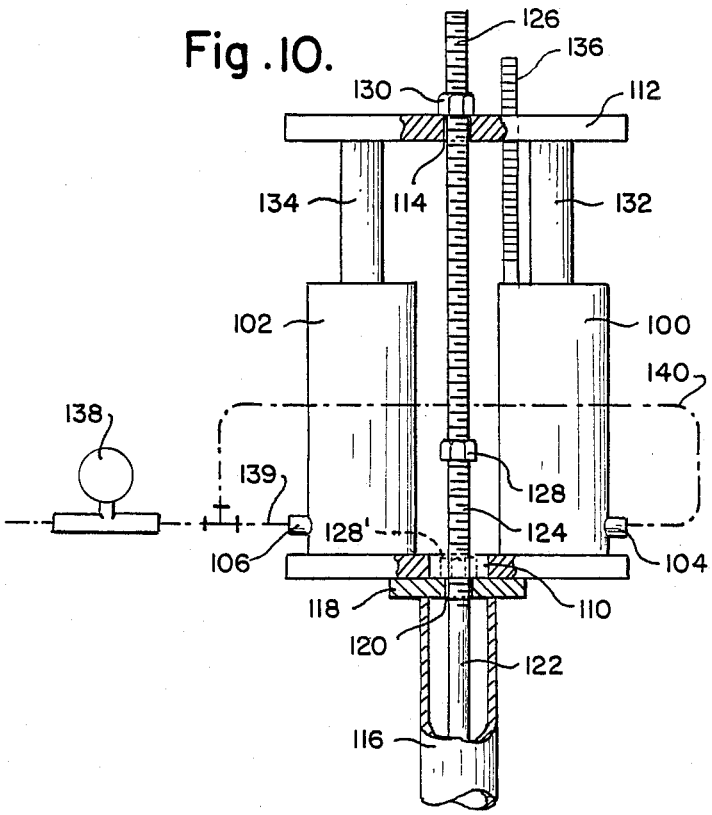
Figure 13:
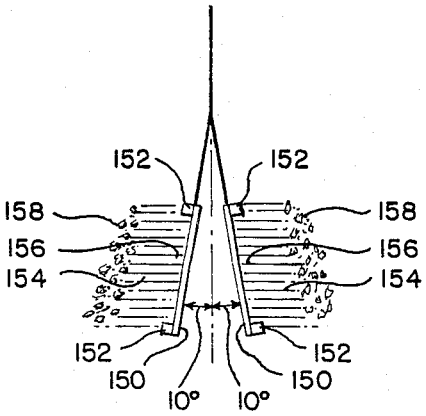
Figure 14:
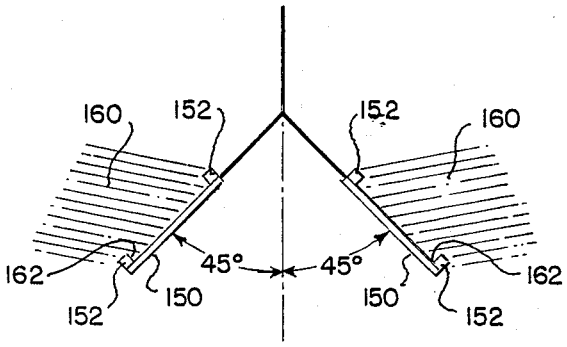
Figure 11:
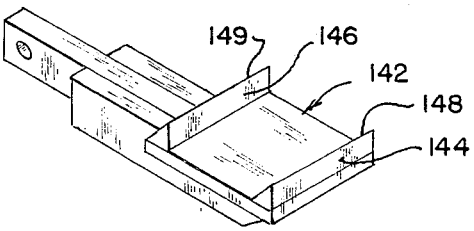
Figure 12:
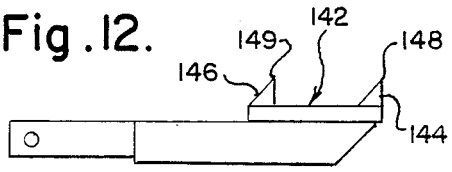
Figure 15:
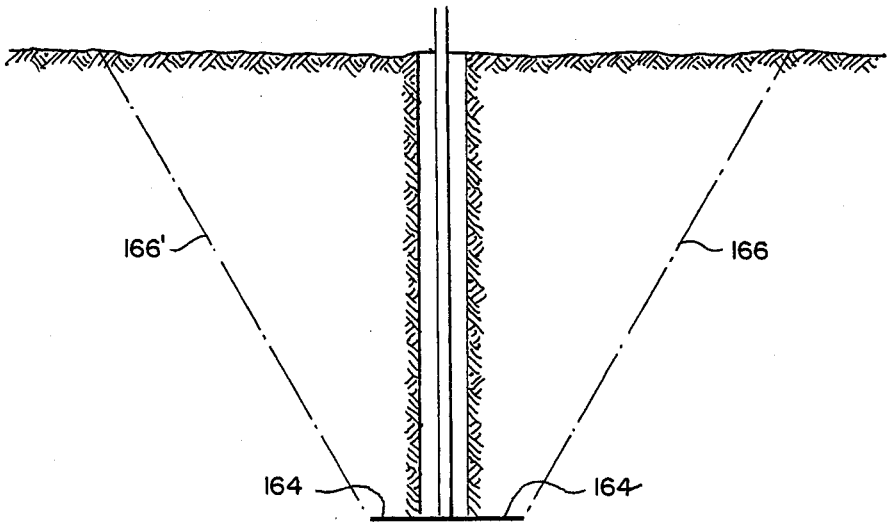
Figure 16:
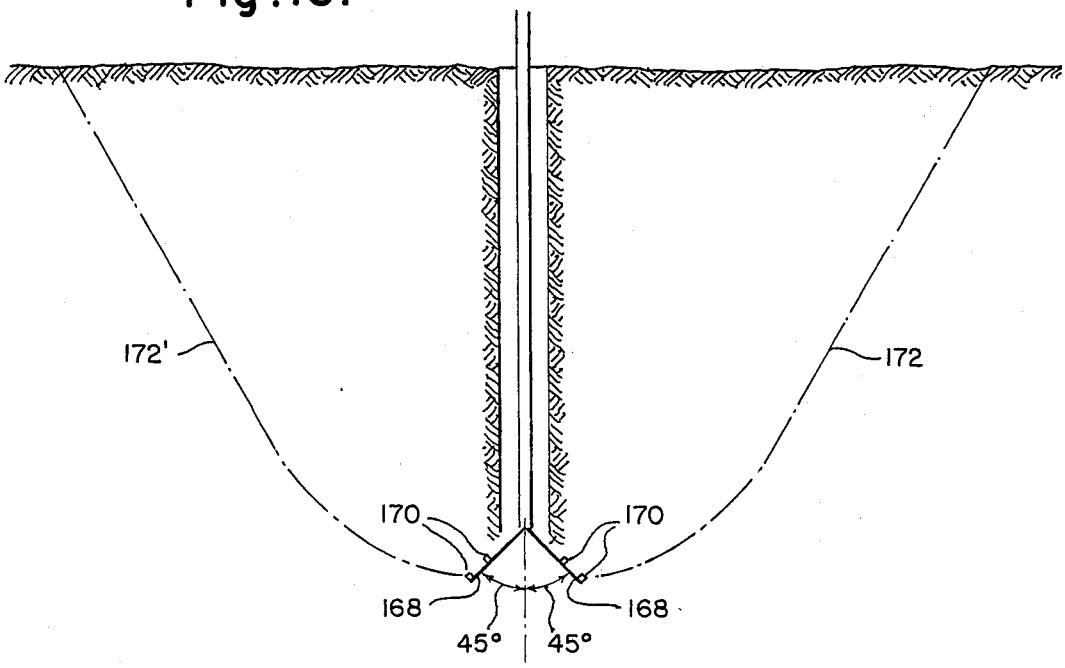
Figure 17:
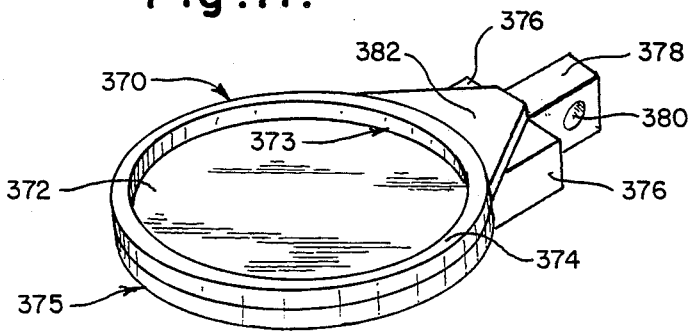
Figure 21:
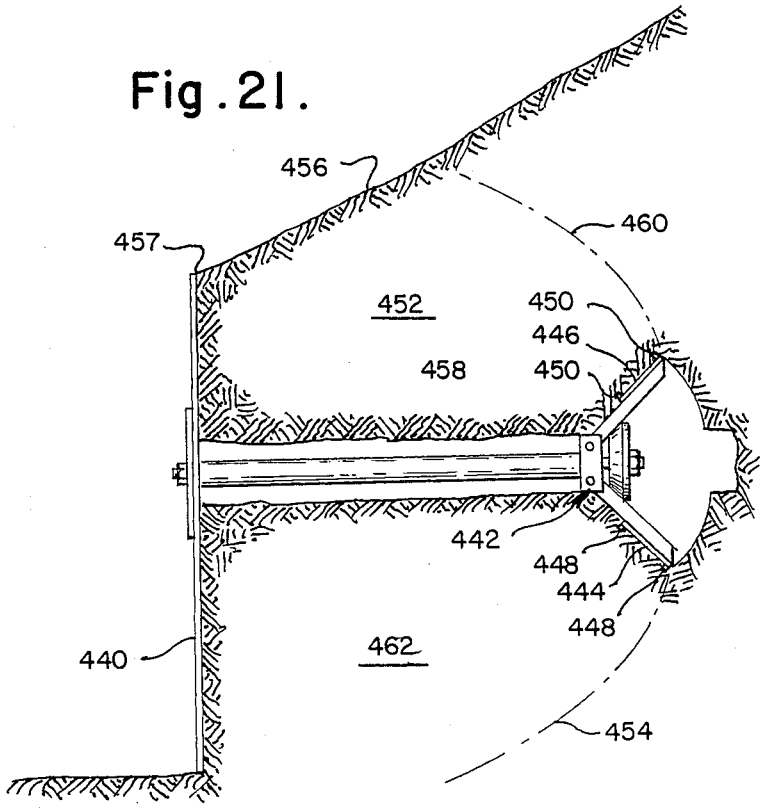
Figure 18:
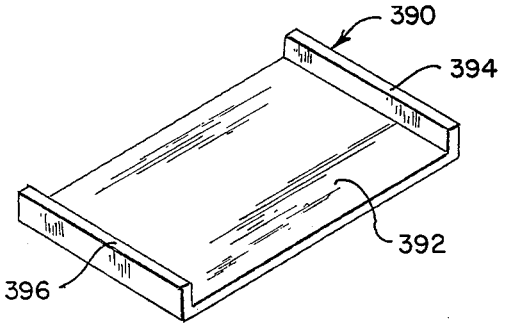
Figure 18A:
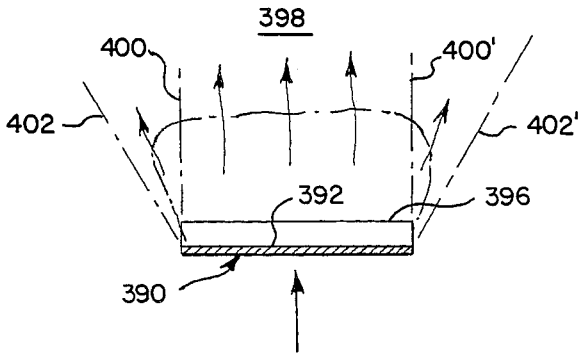
Figure 19:
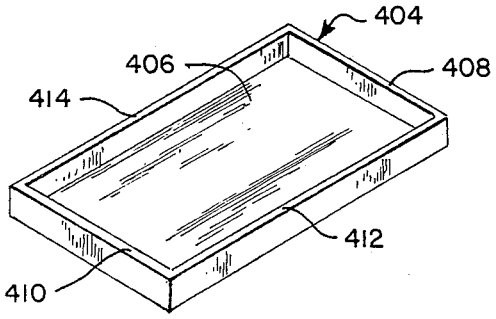
Figure 19A:
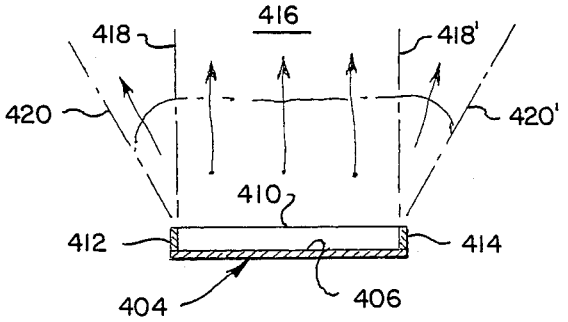
Figure 20:
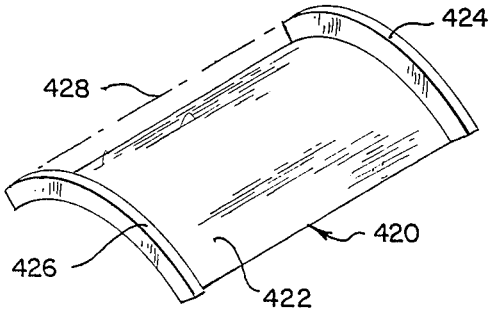
Figure 20A:
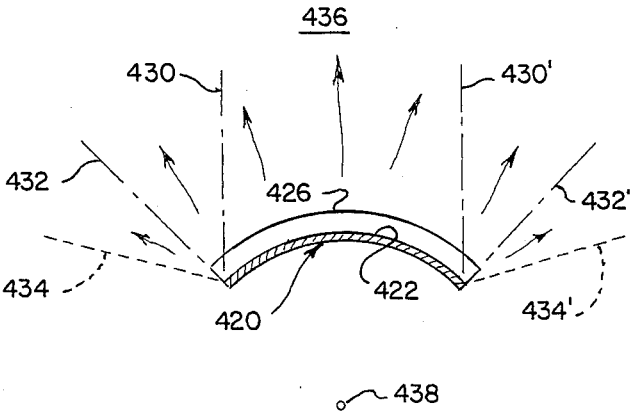

FIG. 6 presents a view of the side of a consolidating and shear control plate facing the containment media;

FIG. 7 presents a view of the other side of a consolidating and shear control plate;

FIG. 8 presents a detail view of the consolidating and shear control plate assembly in extension taken on the line VIII—VIII of FIG. 2;

FIG. 9 presents a fragment of a device including a dual hydraulic piston assembly;

FIG. 10 presents a fragment of a device including a dual hydraulic piston assembly in the operational mode having force measuring means and arc measuring means;

FIG. 11 is an isometric view of an earth consolidation plate for use in rock media;

FIG. 12 is a side view of an earth consolidation plate for use in rock media;

FIGS. 13 and 14 are schematic views illustrating the extent of earth consolidation at varying arcs of swing of the earth consolidation plates into surrounding media;

FIG. 15 is a schematic view illustrating the relatively limited shear plate developed with a plate of the prior art;

FIG. 16 is a schematic view illustrating the much greater shear plane developed with plates having earth containment means of this invention;

FIG. 17 illustrates a circular embodiment of a compaction and consolidation plate;

FIGS. 18 and 18A illustrate a compaction and consolidation plate and its zone of influence in the surrounding media, respectively;

FIGS. 19 and 19A illustrate another compaction and consolidation plate and its zone of influence in the surrounding media, respectively;

FIGS. 20 and 20A illustrate still another compaction and consolidation plate and its zone of influence in the surrounding media, respectively; and FIG. 21 illustrates the employment of the media consolidation effect of an anchor device as a substitute for an earth restraining wall.

Figure 1:
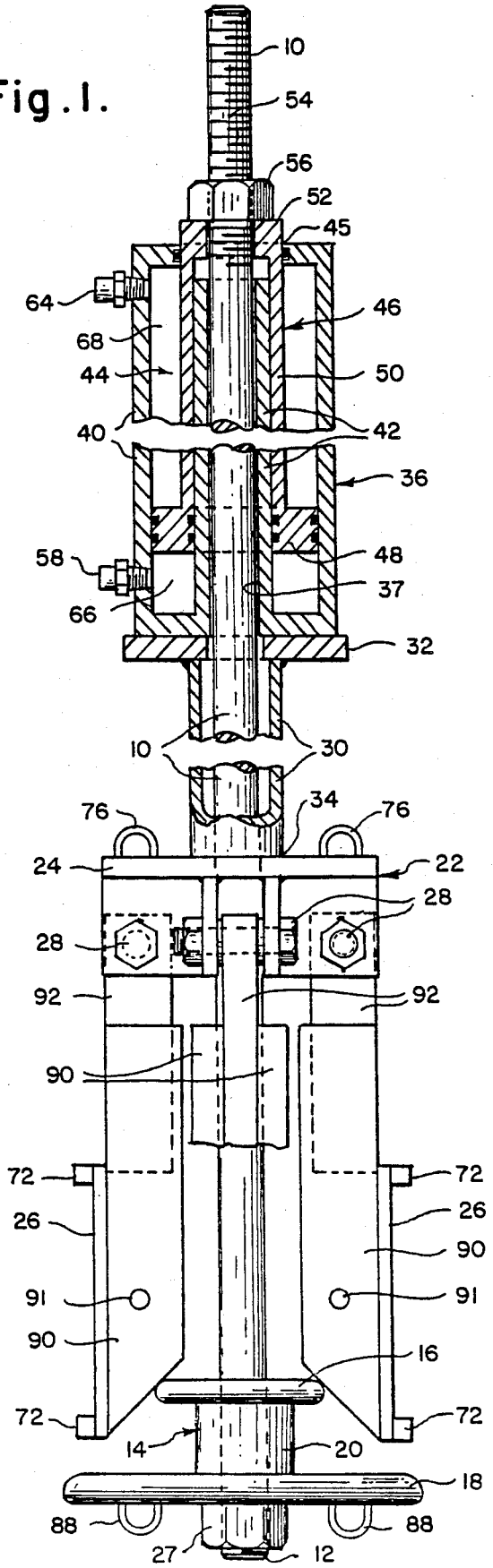
FIG. 1 illustrates our device assembled for the anchor mode, but prior to extension.
Figure 3:
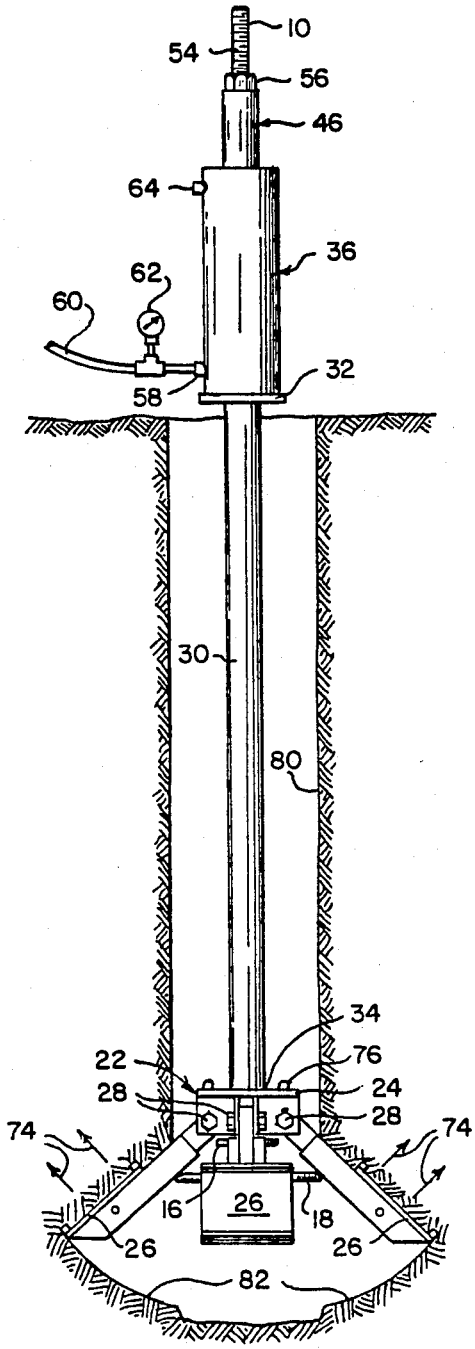
FIG. 3 illustrates our device extended for operation within the anchor mode and positioned in an earthen hole.

Referring first to the anchor mode of FIGS. 1, 2 and 3 it is seen that elongated steel rod 10 is provided with bottom threads 12. The bottom end of rod 10 is then inserted into the central opening of pivot plate assembly 22 which comprises pivot plate 24 having a plurality of consolidation and shear plates 26 swingably attached thereto on pivot pins 28. The bottom end of rod 10 is thereupon inserted into the central opening of a spreader assembly 14. Spreader assembly 14 has an upper and smaller spreader section 16 connected to a lower and larger spreader section 18 by means of a collar 20. Sections 16 and 18 can be joined to form a comparable frusto-conical member. Section 16 can constitute a mechanical stop and serve as limiting means to limit the angular spread accomplished by section 18. Also, the angle between sections 16 and 18 can determine the upper limit of the setting range. Spreader assembly 14 and pivot plate assembly 22 are both slidable on rod 10 along their central openings and are prevented from falling from the bottom end of rod 10 by bottom retainer nut 27.

The partially assembled device comprising rod 10, bottom retainer nut 27, spreader plate assembly 14 and pivot plate assembly 22 is lowered to the bottom of augered earthen hole 80, as shown in FIG. 3. The device is lowered into the earthen hole with consolidating and shear control plates 26 nested compactly against the central rod 10 as shown in FIG. 1, so that spreader 18 is the widest element in the assembly. Therefore, the diameter of augered hole 80 need be only slightly larger than the largest dimension of spreader 18. Thereupon, pipe column 30 having upper flange 32 is mounted on and slid downwardly along rod 10 until its bottom end 34 abuts against the upper surface of pivot plate 24. An hydraulic piston assembly of any type 36 having a central opening 37 is then mounted on and slid downwardly along rod 10 until the bottom end thereof abuts against flange 32 of pipe column 30.

Hydraulic piston assembly 36 comprises an outer cylinder wall 40 and an inner partial cylinder wall 42 defining an annulus 44. Annulus 44 is provided with a movable piston assembly 46 comprising a piston head 48 within annulus 44 and a hollow piston arm 50 extending upwardly out of the interior of annulus 44 through an opening 45 in the top of cylinder 36. Piston arm 50 is also provided with a shoulder 52 at its terminus.

Rod 10 is provided with upper threads 54 for securing upper retainer nut 56 to rod 10. Upper retainer nut 56 is positioned on threads 54 to cause upward movement of rod 10 with piston assembly 46.

Annulus 44 is divided by piston head 48 into oil filled compartments 66 and 68. Compartment 66 is provided with nipple 58 for attachment to a flexible hose 60 for passage of hydraulic fluid to compartment 66 from a hydraulic pump (not shown) to actuate the device (FIG. 3). Compartment 68 has a nipple 64 for attachment to a flexible hose for passage of hydraulic fluid from compartment 68 back to the hydraulic pump reservoir. Although oil is the preferred hydraulic fluid, any other convenient liquid can be used. Also pressurized air can be employed.

When hydraulic fluid is charged to pressure chamber 66, pressure is exerted against piston head 48. The force on piston head 48 forces the piston upwardly to exert an upward force against retainer nut 56. The pressure exerted against piston head 48 forces rod 10 upward while holding pivot plate 24 vertically stationary through a downward force exerted through setting and load bearing column 30. The only avenue of freedom for expansion of compartment 66 to accommodate a continuing increase in fluid pressure is in an upward movement of piston head 48. Such an upward movement allows high pressure compartment 66 to expand into low pressure compartment 68. The expansion of compartment 66 is illustrated by comparing FIGS. 1 and 2 whereby it is seen that pressure chamber 66 is relatively small in FIG. 1 and is relatively large in FIG. 2.

The upward movement of piston assembly 46 pushes upwardly on retainer nut 56 and moves rod 10 and spreader plate assembly 14 up to spread open the consolidation and shear plates 26 on pivot plate assembly 22. The consolidation and shear plates 26 are thereupon forced out on arc which extends outwardly and upwardly under the influence of spreader assembly 14. Consolidation and shear plates 26 swing outwardly by rotation on pivot pins 28 cutting an arc 82 into earthen wall 80 and creating extreme forces. While this swinging occurs, pipe column 30 bears down on pivot plate assembly 22 to serve as restraining means to restrain vertical movement of pivot plate assembly 22. External forces are brought to bear upon the media by the outward movement of the consolidation and shear plates creating consolidation and compaction of the media and positioning of the shear plane away from the consolidation plates and outwardly in the media. This positioning of the shear plane out in the load bearing media is controlled by shear bars or ribs 72 in cooperation with the surface of plates 26 facing the media to contain the media. Further, the normal zone of influence is greatly increased in direct proportion to the degree of consolidation and compaction of the media.

After consolidation and shear plates 26 have been spread to achieve the desired device strength within the setting range for a determined design load, the pressure in chamber 66 can be relieved, and upper retainer nut 56 removed and hydraulic piston assembly 36 slid upwardly and off of rod 10. Hydraulic piston assembly 36 can then be reused in other applications.

The above-described setting action causes the spreader assembly 14 to force the consolidation and shearing plates 26 outwardly generating compaction, consolidation and positioning of the shear plane in the direction indicated by arrows 74. The total delivered setting force as measured by the reading on gauge 62 (FIG. 3) is translated to consolidation and shear plates 26 causing compaction, consolidation and positioning of the shear plane of the bearing soil strata as indicated by arrows 74, as shown in FIG. 3. Gauge 62 reads the developed shear strength of the loaded media at any position within the setting range. At this point the media has been pre-stressed to achieve a loading consolidation equivalent to or greater than the design load. The desired and permanent strength of the media has been achieved through the compaction, consolidation and positioning of the shear plane in the media.

The movement of consolidation and shear plates 26 into the media allows the device in the anchor mode to utilize both the enlarged zone of influence and the shear strength of the media. A controlled shear plane bearing surface is created during compaction and consolidation by the shearing bars or ridges 72 on consolidation and shearing plates 26. An external source of pull or tension, such as a guy wire, can be coupled to rod 10 at upper threads 54 to convert rod 10 into an anchor rod. The hole can then be backfilled or not as desired, depending on the temporary or permanent nature of the installation.

The reading on gauge 62 is the strength of the anchor. A low reading on gauge 62 at full extension or a high reading prior to extension into the preferred setting range indicates that the device must be reset. The device may be removed from the hole by inserting pulling hooks into eyes 76 and then lifting. Inclined ramp 93, shown in FIG. 6, prevents rib 72 from getting caught in the earth during lifting. The earthen hole 80 can then be augered to a greater depth or the consolidation and shear plates can be changed to develop the needed strength at proper extensions. Upon resetting, a desired strength will be indicated by the appropriate reading on gauge 62 within the setting range.

Figure 5:
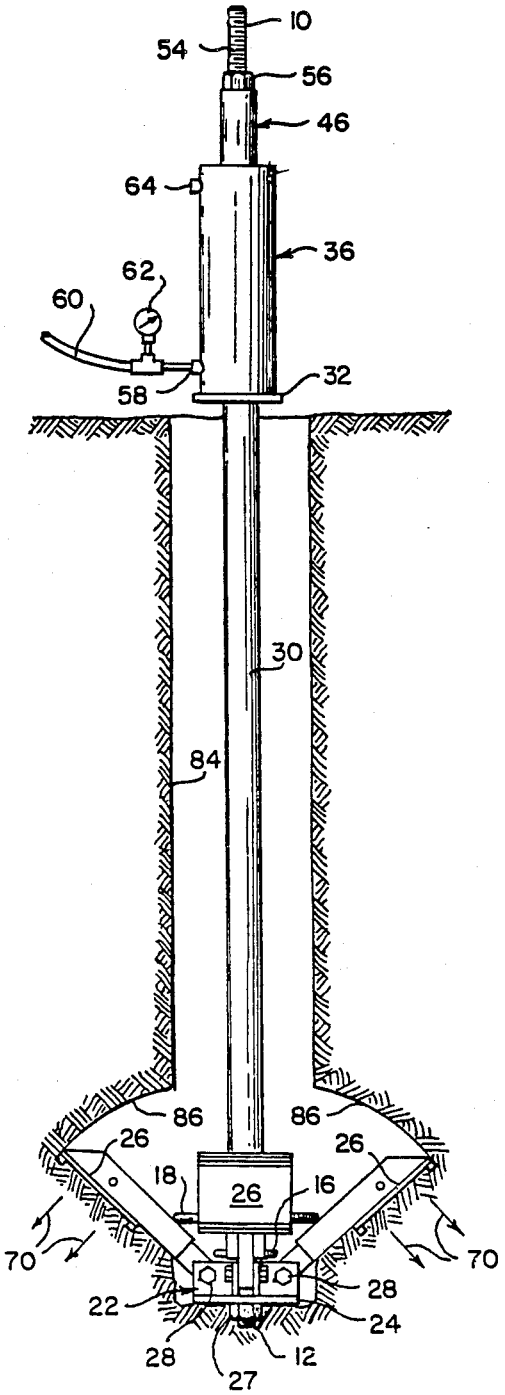
FIG. 5 illustrates our device extended for operation within the foundation mode and positioned in an earthen hole.
Figure 4:
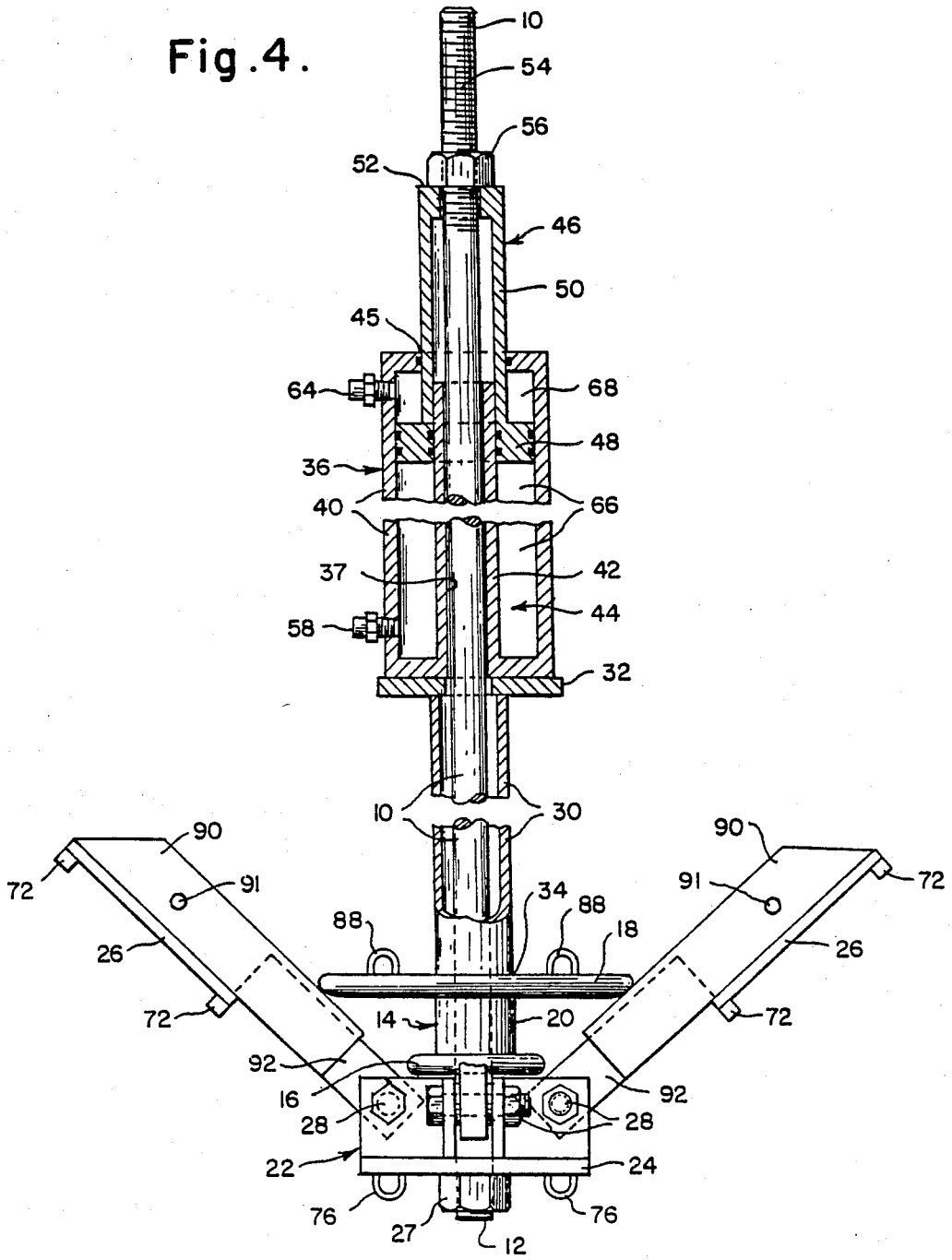
FIG. 4 illustrates our device extended for operation within the foundation mode.

The foundation mode of the invention illustrated in FIGS. 4 and 5 utilizes exactly the same parts as the anchor mode. However, in the foundation mode the combination of spreader plate assembly 14 and pivot plate assembly 22 is reversed and each is inverted, as compared to the anchor mode. This reversal and inversion are the only required changes and are accomplished at the time of assembly. Such exhibits the remarkable versatility of this apparatus. In assembling the device for the foundation mode, the bottom of rod 10 is inserted into the central opening of spreader plate assembly 14, followed by the insertion of the bottom of rod 10 into the central opening of pivot plate assembly 22 which in turn is followed by the screwing into position of bottom retainer nut 27. Plate 16 abutting against pivot plate assembly 22 constitutes limiting means to limit the ability of spreader 18 to spread plates 26 to an arc substantially greater than 45 or 55 degrees.

Rod 10 having spreader plate nut 27, pivot plate assembly 22 and spreader plate assembly 14 mounted thereon is lowered to the bottom of augered earthen hole 84, shown in FIG. 5. Thereupon, pipe column 30 is lowered down rod 10 until its bottom 34 rests on spreader plate 18. Hydraulic piston assembly 36 having a central opening is then lowered down rod 10 until it rests on flange 32 of pipe column 30. Retainer nut 56 is then screwed into place on upper threads 54 of rod 10.

Hydraulic pressure is applied to pressure chamber 66 through hose 60 (FIG. 5). The pressure is indicated on gauge 62. The pressure upon piston head 48 is exerted through shoulder 52 against upper retainer nut 56. Since piston 48 is restrained by nut 56, increasing fluid pressure in chamber 66 causes chamber 66 to expand and force cylinder 40 downwardly against flange 32 of pipe column 30 and thence downwardly against spreader plate assembly 14, pivot plate assembly 22 and bottom retainer nut 27.

The above setting action causes relative movement between rod 10 and pipe column 30 causing the spreader plates 16 and 18 to pivot the consolidation and shear plates 26 outwardly and downwardly into the sides of the earthen hole, cutting arc 86 into the media. Nut 27 restrains plate assembly 24 from vertical movement. The total delivered setting force is translated to consolidation and shear plates 26, causing compaction and consolidation of the bearing soil strata outwardly and downwardly in the direction indicated by arrows 70 (FIG. 5). The result of this consolidation and compaction is that a foundation having an enlarged zone of influence is created for resisting any sinking of the structure into the earth.

The reading on gauge 62 is an indication of the strength of the foundation. A low reading on gauge 62 indicates a low resistance to compaction and consolidation of the media at plates 26, as in a soft or sandy soil. The device can be pulled out of hole 84 after inserting pulling hooks into eyes 88 on spreader plate 18 and after inserting grappling means, not shown, to engage bars 91 on the underside of each consolidation and shear plate 26 (FIGS. 1 and 4). The earthen hole 84 can then be augered to a greater depth at which a harder media or rock formation is available to provide a greater resistance to compaction and consolidation at plates 26, and larger plates may be attached. A greater resistance will be indicated by a high reading on gauge 62 and will provide a more secure foundation.

After consolidation and shear plates 26 have been securely embedded into the earth, the pressure in hydraulic piston assembly 36 is relieved and piston assembly 36 is removed, as earlier described, and reused elsewhere.

When the device is in use in the foundation mode, a building structure will exert a downward force on pipe column 30 spreader plate assembly 14 and thence on consolidation and shear plates 26. This downward force will be resisted by the compacted and consolidated media under plates 26. Because the earth has been compacted and consolidated as indicated at arrows 70 the bearing capacity of the small foundation device as shown in FIGS. 4 and 5 is comparable to a large concrete pile construction without the large costs inherent thereto. Unlike the guess work and conservative oversized volumes of concrete required to ensure adequate support, the foundation of our invention has a known set strength, which is indicated by gauge 62.

FIGS. 6 and 7 illustrate the opposite sides of consolidation and shear plates 26 and show shear plane control ribs 72. Ribs 72 extend along at least two edges of plates 26, as shown in FIG. 6, wherein facing ribs 72 are disposed oppositely from each other and extend along the lower and upper edges of plates 26. If desired, ribs 72 can extend along all four edges of rectangular consolidation and shear plates 26. The side of consolidation and shear plates 26 which contacts spreader assembly 24 is braced by cheek plates 90. Cheek plates 90 embrace a pivot arm 92 having an opening 94 for receiving pivot pin 28, indicated above.

FIG. 8 is a detailed plan view of the anchor mode of the consolidation and shear plate assembly in extension along the line VIII—VIII of FIG. 2. There is always a plurality of compression and shear plates 26 and the preferred number is four, as shown in FIG. 8. All the parts indicated in FIG. 8 were explained above. However, FIG. 8 is presented to more clearly illustrate how compression and shear plates 26 swing outwardly on pivot pins 28 under the influence of spreader assembly 14. Spreader assembly 14 rides entirely behind plates 26

Tests conducted on prototypes of both the anchor and foundation modes of the device of this invention have shown strengths, as indicated by gauge readings, that prior art devices and constructions could only achieve with much larger mass, much greater depth, or a combination of both. Moreover, the strengths of the present device are known with confidence because of the gauge readings while the actual strengths of the prior art devices cannot be known.

FIG. 9 shows a dual hydraulic piston assembly including hydraulic cylinders 100 and 102, having ports 104 and 106, respectively, for the admission of hydraulic fluid. The assembly includes lower supporting plate 108 having central opening 110 and upper lifting plate 112 having central opening 114. The assembly is mounted on pipe column 116 having an upper flange 118 with central opening 120. Rod 122 having threaded regions 124 and 126 for receiving holding nut 128 and restraining nut 130, respectively, extends through and above pipe column 116 and flange 118. Vertical movement of rod 122 actuates consolidation and shear plates, not shown. Prior to engaging restraining nut 130 on rod 122, the entire hydraulic piston assembly is mounted about rod 122 and rests upon flange 118. Thereupon, restraining nut 130 is screwed onto threads 126 and against plate 112.

The operation of the dual hydraulic piston assembly is illustrated in FIG. 10. Fluid under pressure is admitted to hydraulic ports 104 and 106 to actuate pistons within cylinders 100 and 102 which in turn forces piston arms 132 and 134 upwardly. Upward movement of piston rods 132 and 134 lifts plate 112 which in turn raises rod 122 by means of restraining nut 130. The vertical movement of rod 122 causes the spreading of subterranean consolidation and shear plates, not shown. The hydraulic piston assembly is provided with a calibrated scale 136 which relates the extent of lift of piston arms 132 and 134 to degrees of arc opening of the consolidation and shear plates. The assembly is also provided with gauge 138 which is connected to the hydraulic piston assembly through lines 139 and 140. Gauge 138 is calibrated to indicate the force developed to swing the consolidation and shear plates into the surrounding media and is also calibrated to indicate the installed strength developed in the media by the device. It has been determined that the force required to dislodge the device equals the force required to swing the consolidation and shear plates into the surrounding media times a factor of 0.7.

After the consolidation and shearing plates are properly swung into the surrounding media, the hydraulic force can be released. The vertical position of rod 122 may thereafter be secured by screwing holding nut 128 downwardly on threads 124 to position 128', where it abuts against flange 118 to prevent any lowering of rod 122. Thereupon, restraining nut 130 can be removed from rod 122 and the entire hydraulic piston assembly can be lifted from flange 118 for reuse at another location.

FIGS. 11 and 12 show consolidation and shear plate 142 for use in a rock media. Consolidation and shear plate 142 is provided with shear plane control bars 144 and 146 having leading edges 148 and 149, respectively, for biting into rock media. Plate 142 has a relatively narrow width of about one inch because of the hardness of the material which it encounters.

FIGS. 13 and 14 schematically illustrate the occurrence of compaction and consolidation of earth media around outwardly swinging plates 150, each having a pair of shear plane control bars or ridges 152. FIG. 13 shows plates 150 swung outwardly over a relatively small arc of 10 degrees, measured from the vertical. Some consolidation of earth into a rock-like material, as indicated at 154 is occurring within and near containment zones 156 defined by ridges 152 and the surface of plates 150 facing the media. The material beyond the consolidated material is compacted but non-consolidated earth, as indicated at 158.

FIG. 14 shows earth consolidation and shear plates 50 spread outwardly into the surrounding media over a greater arc of 45 degrees. It is seen that the rock-like formation 160 due to consolidation is now greatly extended, compared to FIG. 13. It is noted that the ridges 152 provide locking ledges, as indicated at positions 162, resisting any shear of rock-like formation 160 relative to the surface of plates 150 upon dislodgement.

The enlargement of shear plane upon dislodgement when employing the consolidation and shear plates of this invention is illustrated by a comparison of FIGS. 15 and 16. FIG. 15 shows plates 164 which are not equipped with the shear plane control bars of this invention extended into surrounding earth media over an arc of 90 degrees, which is the customary arc for plates not equipped with the shear plane control bars of this invention. The shear plane generated upon dislodgement is indicated at 166 and 166'. FIG. 16 shows consolidation plates 168 each provided with a pair of shear plane control bars 170. Plates 168 are extended into the surrounding earth media over an arc of 45 degrees. A much greater shear plane as indicated at 172 and 172' is generated upon dislodgement, as compared to shear plane 166 and 166' of FIG. 15. Consolidation and shear plates 168 having ridges 170 provide their maximum shear plane at an extension of 45 degrees, and the shear plane would decrease at an extension greater than 45 degrees. The prior art device of FIG. 15 does not have a comparable critical arc of extension.

FIG. 17 shows earth compaction and consolidation plate assembly 370. Plate 370 includes media facing surface 372 having a curved edge configuration which defines a circle but whose surface is flat. Surface 372 is entirely surrounded by circular media entrapment rib 374. The general region 373 and the diametrically opposite region 375 represent lower and upper edge regions, respectively, for purposes of media containment rib designation. The assembly also includes underlying cheek plates 376 which embrace pivot arm 378 having pivot opening 380. Kickout plate 382 constitutes a ramp which inclines downwardly and away from the rib means at lower edge 373 towards pivot arm 378. Kick out plate 382 serves the function of preventing the rib at lower edge 373 from being caught in the media when the plate is used in the anchor mode and is being collapsed for removal from an earthen hole after being set.

Plate 370 illustrates a media consolidation plate of this invention having a curved edge configuration. Media consolidation plates of this invention can have circular or oval edge configurations as well as square or rectangular edge configurations. Plate 370 also illustrates that the media consolidation rib can extend around the entire periphery of media consolidation surface 372, as well as around only a portion of said periphery. When the rib extends around the entire periphery, the rib segment relatively close to pivot arm 378 is defined as the lower media containment rib and the opposing rib segment relatively remote from pivot arm 378 is defined as the upper media containment rib.

FIG. 18 shows media consolidation plate 390 having media facing surface 392 and inward and outward media containment ribs 394 and 396, respectively. FIG. 18A shows a cross-section of plate 390 taken across media facing surface 392 facing rib 396 and shows the zone in surrounding media 398 through which plate 390 exerts a compaction and consolidation influence upon an outward swing. FIG. 18A shows that the zone of compaction and consolidation projects vertically above the entire media facing surface 392 as indicated by broken lines 400-400'. In addition, the zone of compaction and consolidation influence diverges outwardly from each side edge of surface 392 at an angle of about 30 degrees on each side, as indicated by broken lines 402-402'. The distance between broken lines 402-402' illustrates the full lateral extent of the media compaction and consolidation zone 398.

FIG. 19 shows media consolidation plate 404. Plate 404 comprises media facing surface 406 and inward and outward media containment ribs 408 and 410, respectively. Plate 404 is also provided with side edge media containment ribs 412 and 414 FIG. 19A shows a cross-sectional view of plate 404 taken across media facing surface 406 facing rib 410 and shows the zone 416 in the surrounding media through which plate 406 exerts a compaction and consolidation influence upon an outward swing. The zone of compaction and consolidation influence projects vertically above the entire media facing surface 406 as indicated by broken lines 418-418'. In addition, the zone of compaction and consolidation influence diverges outwardly from surface 410 at each side edge thereof at an angle of about 30 degrees, as indicated by broken lines 420-420'. Thereby, the distance between broken lines 420-420' illustrates the full lateral extent of media compaction and consolidation zone 416.

FIG. 20 shows media and consolidation plate 420. Plate 420 comprises convex media facing surface 422 and inward and outward media containment ribs 424 and 426, respectively. Optionally, plate 420 can be provided with side media containment ribs, as indicated by dashed line 428. Media facing surface 422 is convex in the direction facing the media and ribs 424 and 426 comprise a convex arch to conform with the convex surface.

FIG. 20A shows a cross-sectional view of plate 420 taken across media facing surface 422 in the direction facing rib 426 and shows zone 436 in the surrounding media through which plate 420 exerts a compaction and consolidation influence upon an outward swing. FIG. 20A shows that the zone of compaction and consolidation influence is considerably greater when employing a convex media facing surface as compared to a flat media facing surface. For example, if surface 422 were flat, its vertically upward projection would be indicated by vertical dashed lines 430-430'. However, in the case of convex surface 422 the zone of compaction and consolidation is favorably influenced by the radius of curvature, as indicated by lines 432-432' extending radially outwardly from center of curvature 438 and intersecting the side edges of plate 420. Furthermore, the zone of compaction and consolidation influence diverges outwardly from radial lines 432-432' an additional 30 degrees on each side, to provide an ultimate enlarged lateral zone of influence indicated by the dashed lines 434-434'.

By comparing dashed lines 434-434' in the case of convex plate 420, with dashed lines 420-420' in the case of flat plate 406 and with dashed lines 402-402' in the case of flat plate 390, it is seen that the lateral zone of compaction and consolidation influence when employing a convex plate is advantageously considerably wider than the zone of lateral influence when employing a consolidation plate having a flat surface.

FIG. 21 illustrates a system utilizing the earth consolidation feature of this invention for slope stabilization and as a tie-back for a retaining wall. In FIG. 21, retaining wall 440 is employed to stabilize an earth embankment created by cutting hill 456 at location 457. Horizontal hole 458 is augered into hill 456 and anchor device 442 is inserted and set. Compaction and consolidation plates 444 and 446 are swung outwardly into the surrounding media. Plate 444 is provided with oppositely facing earth containment ribs 448 so that media consolidation zone 462 having shear line 454 is created. Plate 446 is provided with oppositely facing earth containment ribs 450 so that media consolidation zone 452 having shear line 460 is created. Earth consolidation zones 452 and 462 tend to stabilize soil in hill 456. Furthermore, the anchor serves as a tie-back for retaining wall 440.

In the foregoing specification we have described a presently preferred embodiment of our invention and method of practicing the invention. However, it will be understood that the invention can be otherwise embodied and practiced within the scope of the following claims.

We claim:

1. Anchoring or foundation apparatus to be installed in an earthen hole, said apparatus comprising vertical support means, a plurality of spaced media consolidation plates swingably mounted about respective pivot points on said vertical support means, said plates having media facing surfaces, the edge of each facing surface relatively close to said vertical support means being the lower edge and the opposite edge being the upper edge, oppositely disposed rib means extending along said upper and lower edges, respectively, and spaced from said respective pivot points means for swinging said plates and said oppositely disposed rib means, outwardly from said vertical support means into the surrounding media, said oppositely disposed rib means resisting frictional failure of media along said media facing surfaces and wedging plugs of consolidated media onto said media facing surfaces as a result of said swing.

2. The apparatus of claim 1 including force applying means for swinging said plates outwardly.

3. The apparatus of claim 2 wherein said force applying means comprises hydraulic motor means, and gauge means for measuring the hydraulic force being applied by said force applying means.

4. The apparatus of claim 3 wherein said gauge means is calibrated to measure the installed strength developed in said media by said apparatus.

5. The apparatus of claim 1 including plate assembly means mounted about said vertical support means with said plates pivotally mounted on said plate assembly means.

6. The apparatus of claim 1 wherein said vertical support means comprises vertical central rod means secured within a pipe column.

7. The apparatus of claim 1 including swing limiting means to limit the swing of said plates to an arc of substantially 55 degrees.

8. The apparatus of claim 1 including swing limiting means to limit the swing of said plates to an arc of substantially 45 degrees.

9. The apparatus of claim 1 including ramp means inclining downwardly from said rib means at said lower edge toward said vertical support means.

10. The apparatus of claim 1 including measuring means for measuring the arc of swing of said plates.

11. The apparatus of claim 1 wherein said media facing surfaces are rectangular.

12. The apparatus of claim 1 wherein said media facing surfaces are curved convex to said media and said rib means have corresponding convex curvature.

13. The apparatus of claim 1 wherein said media facing surfaces are flat and have curved edges and said rib means are correspondingly curved.

14. The apparatus of claim 1 wherein said media facing surfaces are defined by circular edges and said rib means are correspondingly circular.

15. The apparatus of claim 14 wherein said media facing surfaces are rectangular and have side edges with a second set of oppositely disposed rib means extending along said side edges.

16. The apparatus of claim 1 wherein said media facing surfaces are defined by curved edges and have rib means extending around the entire extent of said curved edges.

17. The apparatus of claim 1 wherein said media facing surfaces are defined by circular edges and have rib means extending around the entire extent of said circular edges.

18. The apparatus of claim 1 wherein said media facing surfaces are flat.

19. A method for installing an anchor for foundation device in the earth comprising preparing a hole in the earth, lowering into said hole an anchor or foundation device having swingable media facing plates said plates having media facing surfaces with upper and lower edges and oppositely disposed rib means extending along said upper and lower edges, applying force to swing said plates and said oppositely disposed rib means outwardly into the surrounding media, during said swing said rib means cooperating with the media facing surfaces of said plates to contain respective plugs of the surrounding media to consolidate said media.

20. The method of claim 19 wherein said force is a fluid force.

21. The method of claim 19 including restraining said device against vertical movement during said swing.

22. The method of claim 19 including swinging said plates to an arc of no more than 45 degrees.

23. The method of claim 19 including swinging said plates to an arc of no more than 55 degrees.

24. The method of claim 19 wherein said force is a fluid force and measuring said fluid force.

25. The method of claim 19 wherein said plates are adapted to swing on pivots.

26. The method of claim 19 including collapsing said device and removing it from said hole.

27. Anchoring or foundation apparatus to be installed in an earthen hole comprising central rod means, plate assembly means mounted around said rod means, pipe column means around said central rod means and above said plate assembly means, said plate assembly means having a plurality of circumferentially spaced media consolidation plates having media facing surfaces with upper and lower edges, said media consolidation plates pivotally mounted thereon and swingable outwardly therefrom about respective pivot points in a substantially vertical arc, spreader means adapted to swing said plates outwardly into the surrounding media upon relative vertical movement between said pipe column means and said rod means, restrainer means to restrain said plate assembly means from vertical movement, said spreader means being adapted to spread said plates to an arc of no more than about 55 degrees, force applying means adapted to provide relative vertical movement between said pipe column means and said rod means, oppositely disposed rib means extending along the upper and lower edges of the media facing surfaces of said plates and spaced from said respective pivot points for swingable movement with said plates, adapted to resist frictional failure of media along said media facing surfaces and to wedge plugs of consolidated media onto said media facing surfaces as a result of said swing.

28. The apparatus of claim 27 wherein said arc is no more than 45 degrees.

29. The apparatus of claim 27 having convertibility from the anchor mode to the foundation mode and vice versa by reversing said spreader means and said plate assembly means and by inverting said spreader means and said plate assembly means.

30. Anchoring apparatus to be installed in an earthen hole comprising central rod means, plate assembly means mounted around said rod means, said plate assembly means having a plurality of circumferentially spaced media consolidation plates having media facing surfaces with upper and lower edges, said media consolidation plates pivotally mounted thereon and swingable outwardly therefrom about respective pivot points in a substantially vertical arc, spreader means adapted to swing said plates outwardly into the surrounding media upon vertical movement of said rod means, restrainer means to restrain said plate assembly means from vertical movement during said vertical movement of said rod means, said spreader means being adapted to spread said plates to an arc of no more than about 55 degrees, force applying means adapted to vertically move said rod means, oppositely disposed rib means extending along the upper and lower edges of the media facing surfaces of said plates and spaced from said respective pivot points for swingable movement with said plates, adapted to resist frictional failure of media along said media facing surfaces and to wedge plugs of consolidated media onto said media facing surfaces as a result of said swing.

31. The apparatus of claim 30 wherein said arc is no more than 45 degrees.

32. The apparatus of claim 30 wherein said spreader means is adapted to spread said plates to an arc of substantially 30 to 45 degrees.

33. The apparatus of claim 30 including limiting means to limit said swing to a maximum arc of about 45 degrees.

34. The apparatus of claim 30 wherein said rib means possess a blunt leading surface.

35. The apparatus of claim 30 wherein said rib means possess a leading edge.

36. The apparatus of claim 30 including means for measuring the amount of said arc.

37. The apparatus of claim 30 including holding means to hold said spreader means in its final position.

38. The apparatus of claim 30 wherein said force applying means is hydraulic pump means.

39. The apparatus of claim 30 wherein said spreader means includes frusto-conical bearing means adapted to ride against bearing surfaces entirely behind said plates and cause said plates to swing outwardly in an arc about their pivots.

40. The apparatus of claim 30 including hook receiving means for removing said apparatus from said hole.

41. Anchoring apparatus to be installed in an earthen hole comprising central rod means, plate assembly means mounted around said rod means, said plate assembly means of having a plurality of circumferentially spaced media consolidation plates having media facing surfaces with upper and lower edges, said media consolidation plates pivotally mounted thereon and swingably outwardly therefrom about respective pivot points in a substantially vertical arc, spreader means adapted to swing said plates outwardly into the surrounding media upon vertical movement of said rod means, restrainer means to restrain said plate assembly means from vertical movement during said vertical movement of said rod means, said spreader means being adapted to spread said plates to an arc of no more than about 55 degrees, force applying means adapted to vertically move said rod means, oppositely disposed rib means extending along the upper and lower edges of the media facing surfaces of said plates and spaced from said respective pivot points for swingable movement with said plates, adapted to resist frictional failure of media along said media facing surfaces and to wedge plugs of consolidated media onto said media facing surfaces as a result of said swing and gauge means for measuring the force being applied by said force applying means.

42. The apparatus of claim 41 wherein said arc is no more than 45 degrees.

43. The apparatus of claim 41 wherein said gauge means is calibrated to indicate the installed strength developed in the media by the apparatus.

44. Foundation apparatus to be installed in an earthen hole comprising central rod means, plate assembly means mounted around said rod means, pipe column means around said central rod means and above said plate assembly means, said plate assembly means having a plurality of circumferentially spaced media consolidation plates having media facing surfaces with upper and lower edges, said media consolidation plates pivotally mounted thereon and swingable outwardly therefrom about respective pivot points in a substantially vertical arc, spreader means adapted to swing said plates outwardly into the surrounding media upon relative vertical movement between said pipe column means and said rod means, restrainer means to restrain said plate assembly means from vertical movement, said spreader means being adapted to spread said plates to an arc of no more than about 55 degrees, force applying means adapted to provide relative vertical movement between said pipe column means and said rod means, oppositely disposed rib means extending along the upper and lower edges of the media facing surfaces of said plates and spaced from said respective pivot points for swingable movement with said plates, adapted to resist frictional failure of media along said media facing surfaces and to wedge plugs of consolidated media onto said media facing surfaces as a result of said swing.

45. The apparatus of claim 44 wherein said arc is no more than 45 degrees.

46. The apparatus of claim 44 wherein said spreader means is adapted to spread said plates to an arc of substantially 30 to 45 degrees.

47. The apparatus of claim 44 including limiting means to limit said swing to an arc of about 45 degrees.

48. Foundation apparatus to be installed in an earthen hole comprising central rod means, plate assembly means mounted around said rod means, pipe column means around said central rod means and above said plate assembly means, said plate assembly means having a plurality of circumferentially spaced media consolidation plates having media facing surfaces with upper and lower edges, said media consolidation plates pivotally mounted thereon and swingable outwardly therefrom about respective pivot points in a substantially vertical arc, spreader means adapted to swing said plates outwardly into the surrounding media upon relative vertical movement between said pipe column means and said rod means, restrainer means to restrain said plate assembly means from vertical movement, said spreader means being adapted to spread said plates to an arc of about 55 degrees, force applying means adapted to provide relative vertical movement between said pipe column means and said rod means, oppositely disposed rib means extending along the upper and lower edges of the media facing surfaces of said plates and spaced from said respective pivot points for swingable movement with said plates, adapted to resist frictional failure of media along said facing surfaces and to wedge plugs of consolidated media onto said media facing surfaces of said plates as a result of said swing and gauge means for measuring the force being applied by said force applying means.

49. The apparatus of claim 48 wherein said arc is no more than 45 degrees.

50. A method for installing an anchor or foundation into the earth comprising preparing a hole in the earth, lowering into said hole a supporting structure having media facing plates having media facing surfaces with upper and lower edges, said media facing surfaces being equipped with media containment means comprising oppositely disposed rib means extending along the upper and lower edges of said media facing surfaces, said plates adapted to swing outwardly on pivots into the surrounding media under the influence of a fluid force with said media containment means adapted to cooperate with the media facing surfaces of said plates to contain respective plugs of the surrounding media, applying fluid force to swing said plates and said oppositely disposed rib means outwardly against the surrounding media through an arc of no more than 55 degrees, and restraining said pivots against substantial vertical movement while swinging said plates into said media.

51. The method of claim 50 wherein said arc is no more than 45 degrees.

52. A method for installing an anchor into the earth comprising preparing a hole in the earth, lowering into said hole a supporting structure having media facing plates having media facing surfaces with upper and lower edges, said media facing surfaces being equipped with media containment means comprising oppositely disposed rib means extending along the upper and lower edges of said media facing surfaces, said plates adapted to swing outwardly on pivots into the surrounding media under the influence of a fluid force with said media containment means adapted to cooperate with the media facing surface of said plates to contain respective plugs of the surrounding media, applying fluid force to swing said plates and said oppositely disposed rib means outwardly against the surrounding media through an arc of no more 55 degrees, and restraining said pivots against substantial vertical movement while swinging said plates into said media.

53. The method of claim 52 wherein said arc is no more than 45 degrees.

54. The method of claim 52 including a step for restricting said arc to a maximum angle of 45 degrees.

55. The method of claim 52 wherein said surrounding media is rock, and said arc is 5 to 15 degrees.

56. The method of claim 52 wherein said surrounding media is soil and said arc is 30 to 45 degrees.

57. The method of claim 52 including measuring the amount of said arc by indirect means.

58. The method of claim 52 including holding said spreader means in its final position.

59. A method for installing an anchor into the earth comprising preparing a hole in the earth, lowering into said hole a supporting structure having media facing plates having media facing surfaces with upper and lower edges, said media facing surfaces being equipped with media containment means comprising oppositely disposed rib means extending along the upper and lower edges of said media facing surfaces, said plates adapted to swing outwardly on pivots into the surrounding media under the influence of a fluid force with said media containment means adapted to cooperate with the media facing surfaces of said plates to contain respective plugs of the surrounding media, applying fluid force to swing said plates and said oppositely disposed rib means outwardly against the surrounding media through an arc of no more than 55 degrees, restraining said pivots against substantial vertical movement while swinging said plates into said media, and measuring said fluid force.

60. The method of claim 59 wherein said arc is no more than 45 degrees.

61. The method of claim 59 including a step for restricting said arc to a maximum angle of 45 degrees.

62. A method for installing a foundation into the earth comprising preparing a hole in the earth, lowering into said hole a supporting structure having media facing plates having media facing surfaces with upper and lower edges, said media facing surfaces being equipped with media containment means comprising oppositely disposed rib means extending along the upper and lower edges of said media facing surfaces, said plates adapted to swing outwardly on pivots into the surrounding media under the influence of a fluid force with said media containment means adapted to cooperate with the media facing surface of said plates to contain respective plugs of the surrounding media, applying fluid force to swing said plates and said oppositely disposed rib means outwardly against the surrounding media through an arc of no more than 55 degrees, and restraining said pivots against substantial vertical movement while swinging said plates into said media.

63. The method of claim 62 wherein said arc is no more than 45 degrees.

64. A method for installing a foundation into the earth comprising preparing a hole in the earth, lowering into said hole a supporting structure having media facing plates having media facing surfaces with upper and lower edges, said media facing surfaces being equipped with media containment means comprising oppositely disposed rib means extending along the upper and lower edges of said media facing surfaces, said plates adapted to swing outwardly on pivots into the surrounding media under the influence of a fluid force with said media containment means adapted to cooperate with the media facing surfaces of said plates to contain respective plugs of the surrounding media, applying fluid force to swing said plates and said oppositely disposed rib means outwardly against the surrounding media through an arc of no more than 55 degrees, restraining said pivots against substantial vertical movement while swinging said plates into said media, and measuring said fluid force.

65. The method of claim 64 wherein said arc is no more than 45 degrees.

* * * * *

UNITED STATES PATENT AND TRADEMARK OFFICE

CERTIFICATE OF CORRECTION

PATENT NO. : 4,843,785

DATED : July 4, 1989

INVENTOR(S) : Samuel J. Sero, James S. Collins and Victor Yates

It is certified that error appears in the above-identified patent and that said Letters Patent is hereby corrected as shown below:

Column 8 Line 62 after "26" insert --.--.

Claim 19 Line 31 Column 13 "for" (second occurrence) should read --or--.

Claim 52 Line 67 Column 16 after "more" insert --than--.

Signed and Sealed this

Twenty-fourth Day of April, 1990

*Attest:*

HARRY F. MANBECK, JR.

*Attesting Officer*

*Commissioner of Patents and Trademarks*